US009301602B2

(12) United States Patent
Cardon

(10) Patent No.: US 9,301,602 B2
(45) **Date of Patent: *Apr. 5, 2016**

(54) OVERBED TABLE HOLDER SYSTEM

(71) Applicant: Stewart Cardon, Whitefish, MT (US)

(72) Inventor: Stewart Cardon, Whitefish, MT (US)

( * ) Notice: Subject to any disclaimer, the term of this patent is extended or adjusted under 35 U.S.C. 154(b) by 63 days.

This patent is subject to a terminal disclaimer.

(21) Appl. No.: 14/139,338

(22) Filed: Dec. 23, 2013

(65) Prior Publication Data

US 2015/0173507 A1 Jun. 25, 2015

Related U.S. Application Data

(63) Continuation-in-part of application No. 13/750,011, filed on Jan. 25, 2013, now Pat. No. 8,613,256.

(60) Provisional application No. 61/590,443, filed on Jan. 25, 2012.

(51) Int. Cl.

| | |
|---|---|
| ***A47B 85/00*** | (2006.01) |
| ***A47B 23/06*** | (2006.01) |
| ***A47B 23/04*** | (2006.01) |

(52) U.S. Cl.

CPC ..... *A47B 23/06* (2013.01); *A47B 23/046* (2013.01); *A47B 2200/03* (2013.01)

(58) Field of Classification Search

CPC ..... A47B 13/16; A47D 1/008
USPC ..... 108/25, 26, 152
See application file for complete search history.

(56) References Cited

U.S. PATENT DOCUMENTS

| | | | | | |
|---|---|---|---|---|---|
| 233,170 | A * | 10/1880 | Starr | 108/26 |
| 484,718 | A * | 10/1892 | Isaacs | 273/284 |
| 1,678,375 | A * | 7/1928 | Berssenbrugge | 248/220.1 |
| 1,897,717 | A * | 2/1933 | Appel | 108/26 |
| 1,959,539 | A * | 5/1934 | Latham et al. | 108/26 |
| 1,962,575 | A * | 6/1934 | Sllverman | 108/26 |
| 2,457,285 | A * | 12/1948 | Stopner | 108/26 |
| 2,707,141 | A * | 4/1955 | Witter | 108/26 |
| 4,747,352 | A * | 5/1988 | Guidry et al. | 108/26 |
| 5,295,650 | A * | 3/1994 | Brandt | 248/311.2 |
| 6,253,399 | B1 * | 7/2001 | Wagner | 5/507.1 |
| 6,283,042 | B1 * | 9/2001 | Wargo et al. | 108/26 |
| 6,347,581 | B2 * | 2/2002 | Sahli et al. | 99/542 |
| 6,484,989 | B1 * | 11/2002 | Connery | 248/311.2 |
| 6,802,263 | B1 * | 10/2004 | Kolb | 108/26 |
| 7,314,010 | B2 * | 1/2008 | George et al. | 108/50.01 |
| 8,245,650 | B1 * | 8/2012 | McKsymick | 108/25 |
| 8,613,256 | B2 * | 12/2013 | Cardon | 108/26 |
| 2002/0043181 | A1 * | 4/2002 | Gist | 108/26 |
| 2006/0225624 | A1 * | 10/2006 | Grace | 108/26 |

* cited by examiner

*Primary Examiner* — Jose V Chen
(74) *Attorney, Agent, or Firm* — Dean A Craine

(57) ABSTRACT

An overbed table holder system that allows a patient to dispose personal trash or hold a container filled desirable objects to a patient lying in a hospital bed. The system includes a moveable overbed table, a bag or container holding, an intermediate member disposed between the bag and container holding member and the table's perimeter side edge, and a ring element that receives either a disposable trash bag or a container holder. The ring element is connected to the intermediate member that temporarily snap fits against the perimeter side edge and over the table. During use, a disposable trash bag or one of two types of container holders may be placed over the ring element. Objects or containers may be placed inside the container holder. The intermediate member is forced against the perimeter side edge at a desired location to hold the bag or a container. The intermediate member may be easily moved to any location along the perimeter side edge and remove entirely for cleaning.

10 Claims, 8 Drawing Sheets

OVERBED TABLE HOLDER SYSTEM

This utility patent application is a continuation in part application of U.S. utility patent application Ser. No. 13/750,011 filed on Jan. 25, 2013, which based on and claims the filing date benefit of U.S. provisional patent application No. 61/590,443, filed on Jan. 25, 2012.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

The invention generally relates to infection control systems used in hospitals, skilled nursing facilities, and in nursing homes, and more particularly to disposable trash bag systems for contaminated trash generated by patients lying in a hospital bed.

2. Description of the Related Art

Patients lying in a hospital bed generate personal trash such as gum, facial tissues, napkins, and paper towels that must be properly discarded to prevent the spread of infections.

While most patients know that the trash they generate may be contaminated and should be properly discarded, the personal trash they generate is sometimes left on the overbed table, on the bedding, or dropped on the floor because a trash receptacle was not within easy reach of the patient when lying in the bed. Eventually, the trash is picked up by a healthcare worker or by a family member and deposits it into floor trash receptacle. Unexpectedly, the worker or family member may be contaminated with germs and viruses from the patient.

Overbed tables are commonly used in a hospital to serve food or beverages to a patients lying in a bed. Overbed tables are also used by patients as support surfaces for temporarily holding books, magazines, or for writing or for playing cards. They typically include a rectangular table top mounted at one end to a height adjustable vertical column. The table top is a single, planar structure with a uniform thickness and made of hard, laminated plastic that can be thoroughly sanitized with a suitable disinfectant is manually applied by housekeeping personnel. The lower end of the vertical column is mounted on a low profile base with caster wheels that allows the base to easily roll across the floor and, if desired, extend under the bed. During use, the overbed table may be moved to different positions around the bed to accommodate different positions of a patient lying on a hospital bed, and to accommodate different pieces of medical equipment that may be setup around the bed.

What is needed is a disposable trash bag holder system that holds a disposable trash bag at different locations around a patient lying in different locations on a hospital bed. Such a system should enable the disposable trash bag to be selective moved to accommodate the different positions of the patient in the bed. What is also needed is a system that supports a trash bag in partially open configuration so trash can be easily deposited into the bag without manually manipulating the bag. What is also needed is a holder system that can store or position other objects commonly used by patients lying in a hospital bed including but not limited to beverage containers, tissue or swipe containers, writing implements, gum containers, etc.

What is also needed is a system that satisfies the above needs that does not interfere with commonly used housekeeping tasks employed to reduce bacterial and viral infections in the facility.

SUMMARY OF THE INVENTION

It is an object of the invention disclosed is to provide a disposable trash bag system that includes a holder designed to hold a disposable trash bag in a partially open configuration so it may be easily filled with soiled tissues or objects by the patient laying at different positions and locations in a hospital bed.

It is another object to provide a disposable trash bag system that uses the table top of an overbed table that can be easily moved to different gross locations around patient and can be manually disinfected with a suitable agent.

It is another object to provide such a system that uses a bag holder can be selectively attached and removed from the table top and allows the disposable bag to be easily inserted and removed from the holder using minimal contact to the table top surface, the holder or the bag.

It is a further object to provide a holder system that may also be used to store or conveniently position objects commonly used by patients lying in hospital bedding including but not limited to beverage containers, tissue or swipe containers, or writing implements, that also may contaminated.

These and other objects of the invention are met by system for preventing the spread of infection in a healthcare facility where patients positioned on beds generate personal trash or hold objects that may be contaminated. The system is designed to so the patient themselves may easily dispose of their trash directly into a disposable trash bag or store objects they commonly used so others do not have to handle the trash or the objects. A key feature of the system is using an overbed table that can be repositioned around the bed and a holding device can that selectively attached at any location to the overbed's table perimeter edge. The combined benefits of a moveable overbed table and a holding device can be attached at any location to the table's edge, allows a disposable bag or an object container to be positioned within easy reach of any patient lying in the bed.

More specifically, the system includes an overbed table with a flat, elongated table top with a bag holding device selectively attached at any location to the table top's perimeter side edge. In one embodiment, a bag holder is used in which a disposable trash bag is inserted and rests vertically via gravity over a support structure. Typical overbed tables have a table top that has a uniform thickness and a continuous exposed perimeter side edge. In one embodiment presented, the bag holding device includes two parts—a holding member and an intermediate member. In one embodiment, the holding member and intermediate member are detachable and prior to use, selectively attached to hold an opened disposable bag in a vertically configuration on the side of a table top. The intermediate member attached to the holding member is configured to sufficiently extend laterally from the perimeter side edge and can be selectively attach at any location to the overbed's perimeter side edge. When the bag holding device is made out of two components, the intermediate member may remain attached to the table top and the holding member may be selectively removed enabling housekeeping personal to sanitize the bag holder device and the table top surface.

In the embodiment shown, the holding member includes a rigid ring element with a center opening configured to receive a disposable trash bag closed at one end. The ring structure is circular and acts as a support surface for the upper edge of the disposable trash bag. In one embodiment shown, the disposable trash bag is similar to a small emesis bag with an outer plastic bag body closed at one end and with an upper cardboard ring member disposed around the bag body's top opening the top opening remains open at all times when hung from the ring element. The cardboard ring member also provides rigidity and acts as a semi-rigid support surface for holding the bag body on the ring element.

The ring element is a circular structure and the ring member is a complimentary structure that rests on top of the ring element when the trash bag is installed. In other embodiments, the ring element and the ring member may have other configurations that together temporarily hold the bag body in opened, vertically aligned position for filling.

In the embodiment shown, the intermediate member includes an upper leaf that slides over or snaps fits over the top surface of the overbed's table top, and a lower leaf that slides over or snaps fits over the bottom surface of the overbed table top. The upper and lower leaves are spring-biased to apply light forces on opposite top and bottom surfaces to hold the intermediate member over the perimeter edge of the table top. In other embodiments, the intermediate member may have other configurations that enable it to selectively attach to perimeter edge of the table top.

As mentioned above, In one embodiment, the bag holding device is made of two separate parts—a holding member and an intermediate member. It should be understood that the bag holding device may be one part wherein the holding member and the intermediate member may be integrally attached or formed together.

In other embodiments, the disposable bag is replaced with one or two types of container holders designed to hold other loose objects or containers. In one embodiment, the container holder is a cup-style holder that includes an upper ring member configured to rest on top of the ring element and a downward extending cup with pendent side walls and a bottom surface. In another embodiment, the container holder is a cage-style structure made of two or more U-shaped clips connected together and configured to be supported and held by the ring element when inserted into the center opening on the ring element. In both embodiments, central storage areas are formed in which objects handled by the patient may be placed.

It should also be understood, that the system is defined as used with an overbed table typically used with large beds in which patients are position for rest and medical treatment in a medical treatment facility or department, such beds as a hospital, a medical clinic, a retirement center, an outpatient surgical facility, an alcohol or drug treatment facility, a prison, or a school. It should be understood however, that other types of table top structures may be used in place of the overbed table.

During use, the overbed table may be selectively moved to different locations around the bed that accommodates the patient's position and the medical equipment around the bed. A suitable location on the perimeter edge for the intermediate member is then selected that places the disposable bag or container object for holding an object in a convenient location for the patient. The intermediate member is then attached to the perimeter edge. A disposable bag or container holder is then selected and extended through the ring element's center opening. Discarded personal trash can then be disposed into the bag body or a beverage container, tissue or swipes container or a writing implement may be in the container holder.

DESCRIPTION OF THE PREFERRED EMBODIMENT(S)

Figure 1:
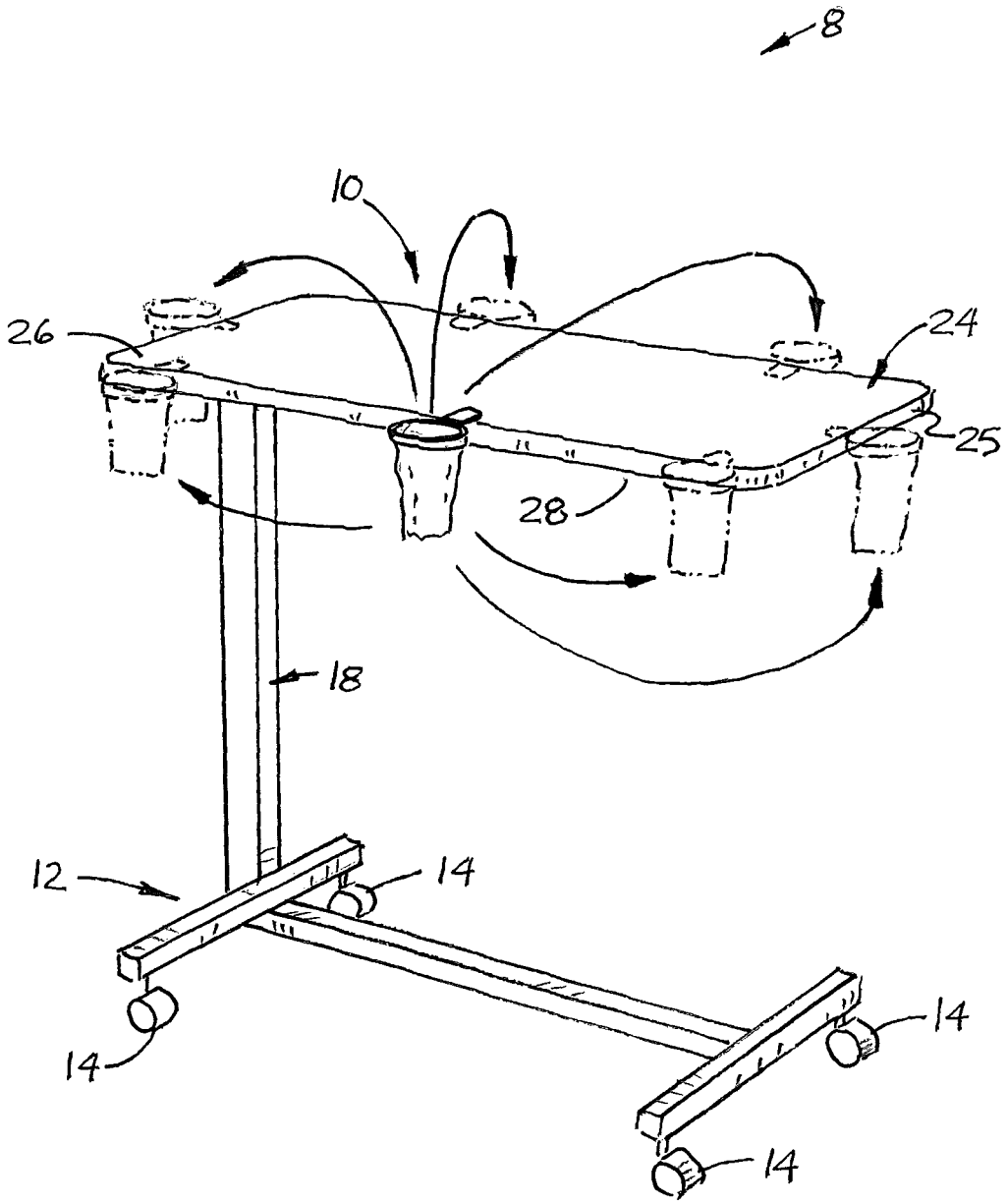
FIG. 1 is a perspective view of an overbed table trash bag holder system showing the trash bag holder being selectively attached to different locations on the overbed table's table top.
Figure 2:
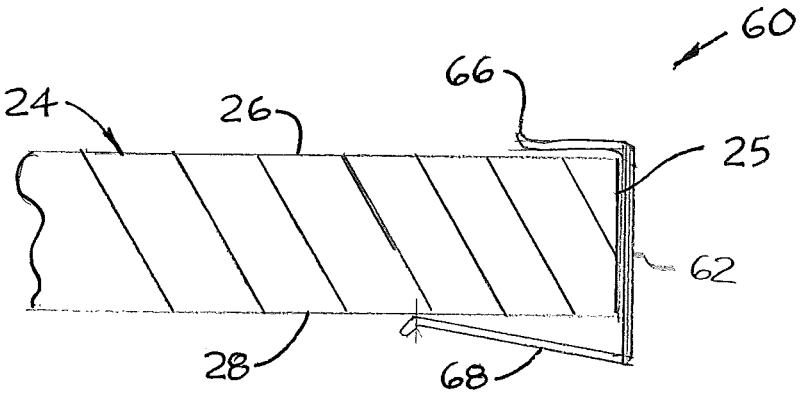
FIG. 2 is a sectional side elevational view of a table top with flat top and bottom surfaces with a U-shaped intermediate member shown attached to the table top's perimeter side edge.
Figure 3:
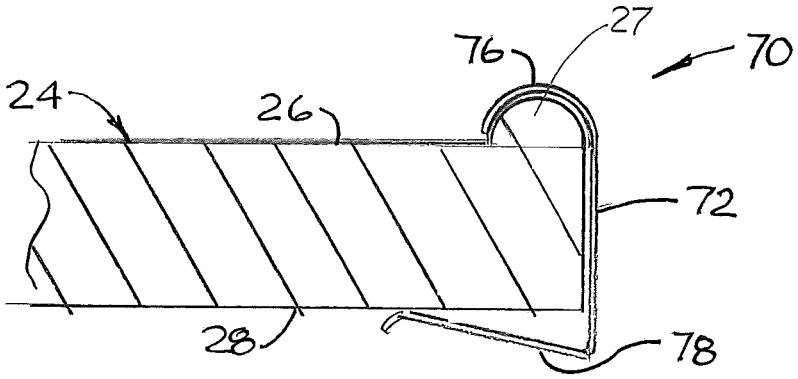
FIG. 3 is a sectional side elevational view of a table top with raised curb formed on the top surface second embodiment of the intermediate member, called a curb engaging intermediate member, shown attached to the table top's perimeter side edge.
Figure 4:
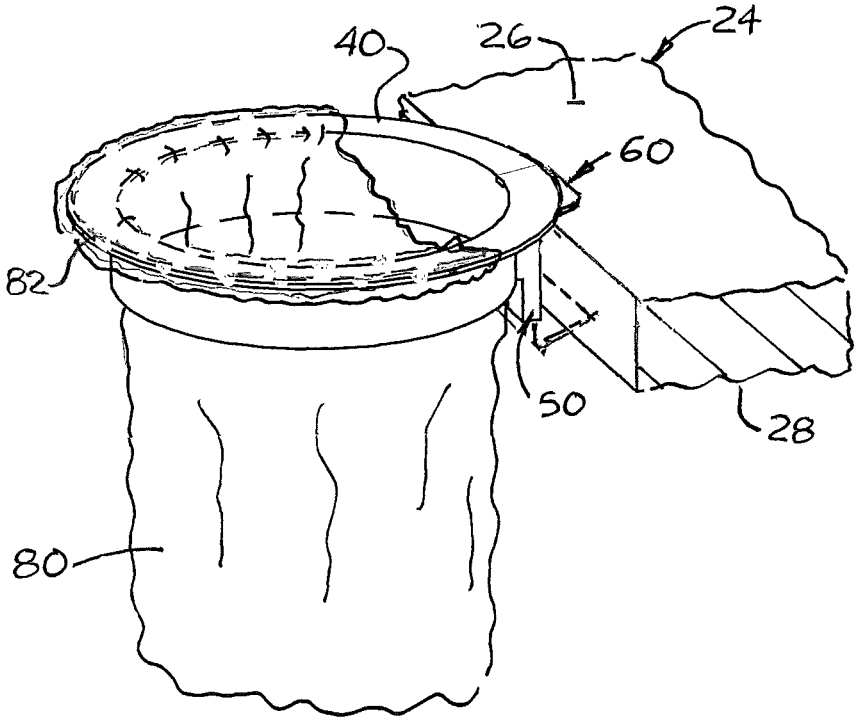
FIG. 4 is a perspective view of the trash bag holder with a U-shaped intermediate member attached to the perimeter side edge of a table top with a ring element attached to the intermediate member and a disposable bag extended into the ring element's center hole.

FIG. 1 is a perspective view of the system 8 disclosed herein that includes an overbed table 10 with an H-shaped lower base 12 mounted on caster wheels 14 that allows it to roll easily over a flat floor. Mounted on the lower base 12 is a perpendicularly aligned, vertical column 18 with a horizontally aligned elongated table top 24 mounted on the upper end of the column 18. The table top 24 includes a flat top and bottom surfaces 26, 28, respectively, and a vertical, continuous perimeter side edge 25. In one embodiment of the table top 24 (see FIGS. 1, 2, and 4), the top and bottom surfaces 26, 28 are parallel and terminate at the perimeter side edge 25. In a second embodiment, the table top 24' has a top surface 26' that includes a raised curb 27 (see FIGS. 3, and 7-9) positioned adjacent to the perimeter side edge 25'.

The system 8 includes a holding member 40, one of two intermediate members 60 or 70 disposed between the holding member 40 and the table's perimeter side edge 25, 25', respectively. In one embodiment, the holding member 40 includes a flat ring element 41 and a laterally extending receiving body 42. Formed inside the ring element 41 is a center opening 46 configured to receive a disposable trash bag 80 or container 90, 100 described further below.

The disposable trash bag 80 is similar to a small emesis bag with an outer plastic bag body 81 with a semi-rigid upper ring 82 disposed around its top opening. In one embodiment, the upper ring 82 is made of cardboard or paper that provides weight and mass and acts as a semi-rigid support surface for expanding and holding the bag body 81 on the top surface of the ring element 41. The bag body 81 has a volume of approximately 1 quart.

Figure 5:
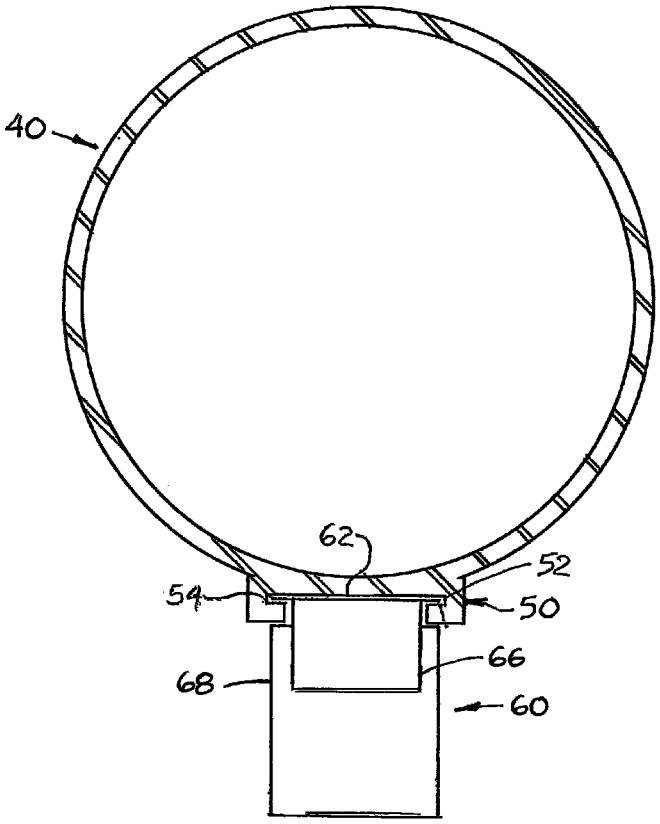
FIG. 5 is a top plan view of trash bag holder showing the bag holder with a U-shaped intermediate member attached to the ring element.

Attached or formed on the outside surface of the receiving body 42 is a receiver 50 that includes at least one slot 52 designed to receive a sleeve member 62 or 72 formed on the two intermediate members 60, 70, respectively. Both intermediate members 60, 70 include a biased perimeter edge engaging member designed to snap fit over the table top's top surface 26. The first embodiment of the intermediate member 60 shown in FIGS. 2, 5 and 6, includes two converging clamping leaves 66 and 68 separated by a vertical sleeve member 62. The length and angle of the two clamping leaves 66 and 68 are configured so the user may easily snap fit the leaves 66, 68 over the top and bottom surfaces 26, 28, respectively, of the table top 24.

In a second embodiment, shown in FIGS. 7-11, the intermediate member 70 includes an upper curb engaging structure 76 and a lower clamping leaf 78. The curb engaging member 76 is designed to be used with a table top 24' with a continuous raised curb 27 formed on the top surface 24 adjacent to the perimeter side edge 25'. On the curb engaging structure 76, replaces the upper clamping member 62 used on the first intermediate member 60.

Figure 6:
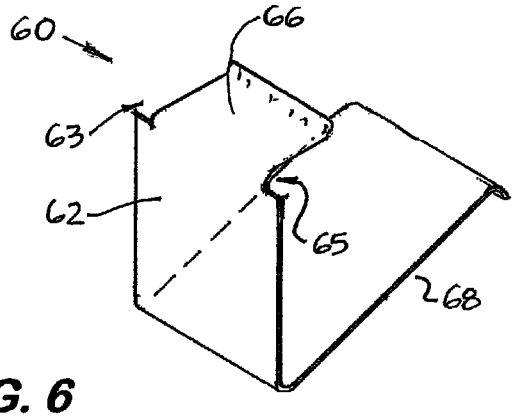
FIG. 6 is a perspective view of the U-shaped intermediate member.
Figure 7:
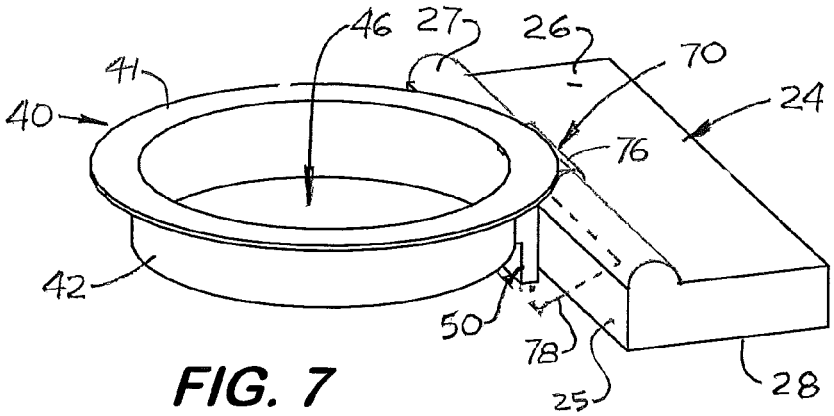
FIG. 7 is a perspective view of the second embodiment of the bag trash holder being attached to a curb style overbed table that uses a curb engaging intermediate member that snap fits around the curb.
Figure 8:
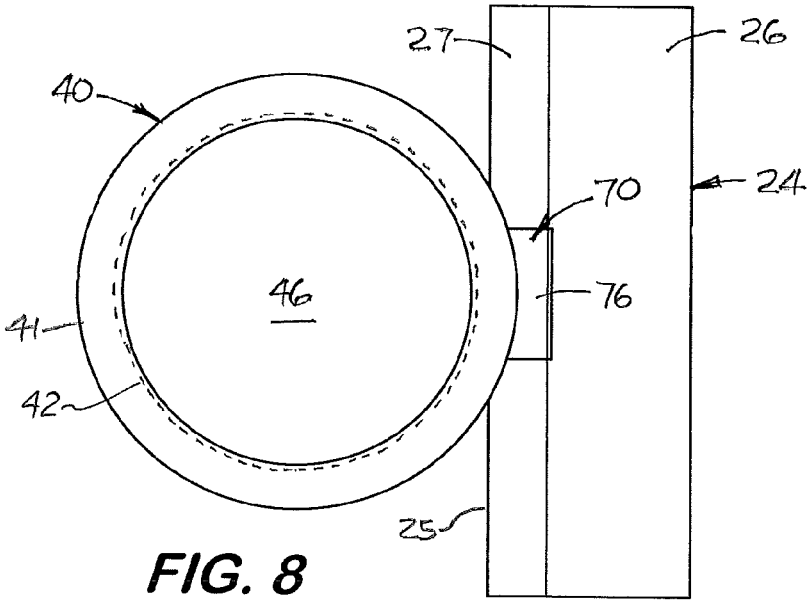
FIG. 8 is a top plan view of the second embodiment shown in FIG. 7.
Figure 9:
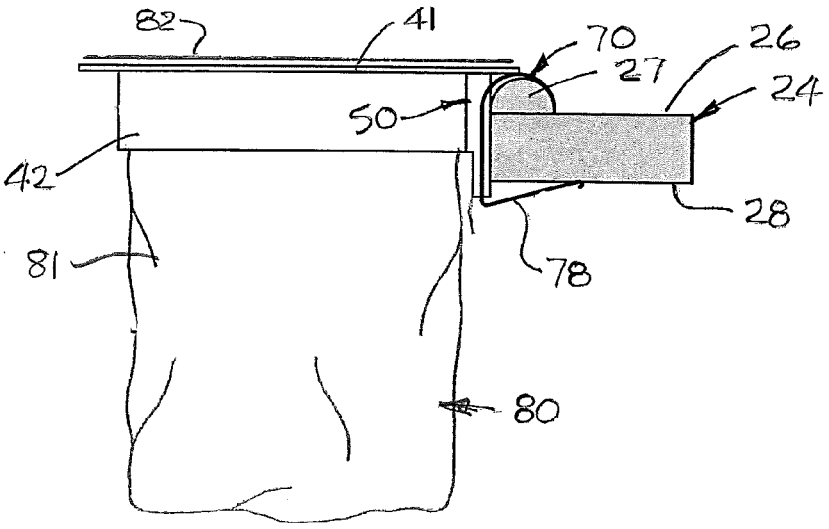
FIG. 9 is a side elevational view of the second embodiment shown in FIGS. 7 and 8.
Figure 10:
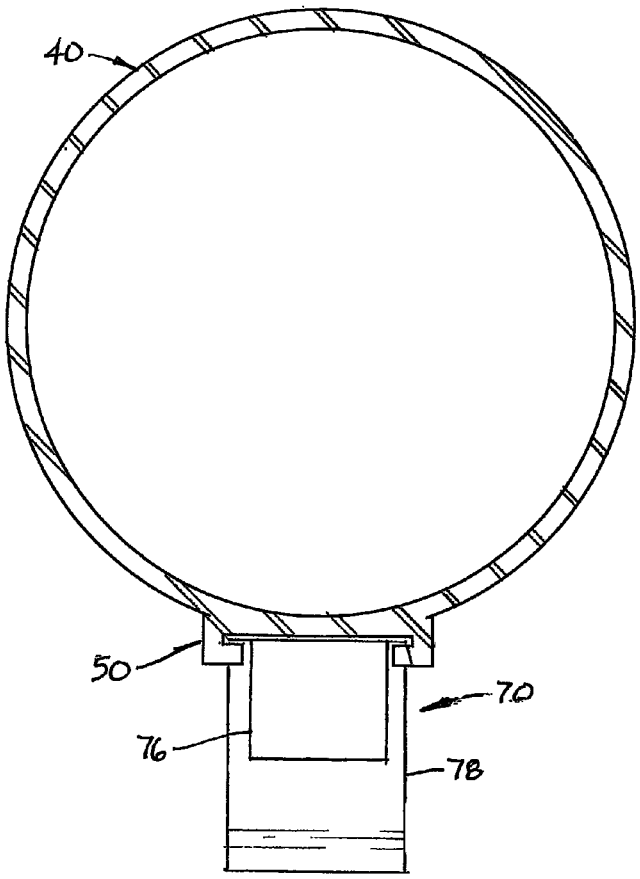
FIG. 10 is a top plan view of the second embodiment shown in FIGS. 7-9.
Figure 11:
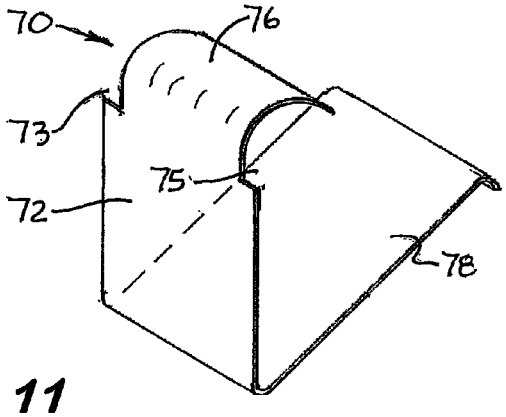
FIG. 11 is a perspective view of the curb engaging intermediate member.

As shown more clearly in FIG. 6, formed on the sleeve member 62 are two upper cutouts 63, 65 that enable the sleeve member 62 to slide into the two slots 52, 54, respectively, formed on the receiver 50. During assembly, the intermediate member 60 is tightly held within the two slots 52, 54 formed on the sleeve member 62 (see FIG. 5). When properly attached, the two clamping leaves 66, 68 press tightly against the top and bottom surfaces 25, 26, respectively, of the table top 24 and hold the sleeve member 62 in placed against the perimeter side edge 25.

During use, the overbed table 10 may be moved so the table top 24 can be positioned at any desirable location adjacent or partially over the patient. The intermediate member 60 or 70 may be moved to any desired location on the perimeter side edge 25, 25', respectively, to accommodate the table top's new location relative to the patient.

Figure 12:
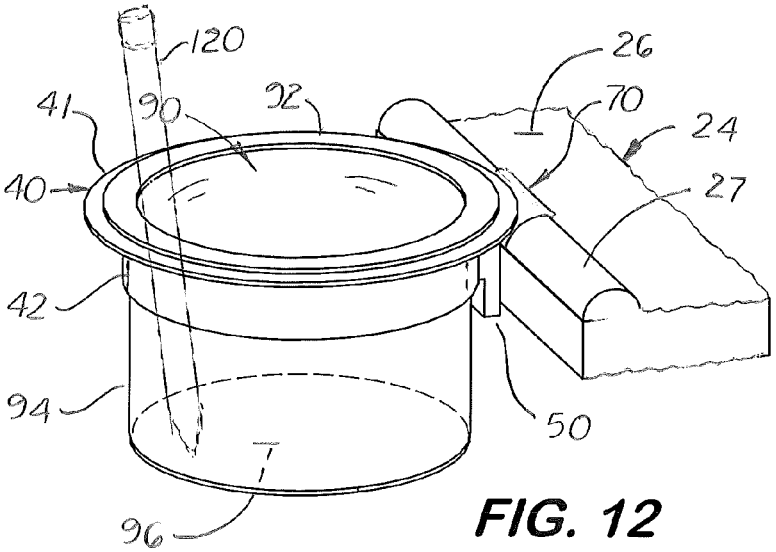
FIG. 12 is a perspective view of the holding member with a U-shaped intermediate member attached to the perimeter side edge of a table top with a ring element attached to the intermediate member and a cup-style container holder placed into the ring element's center hole and a writing implement placed into the holder.
Figure 13:
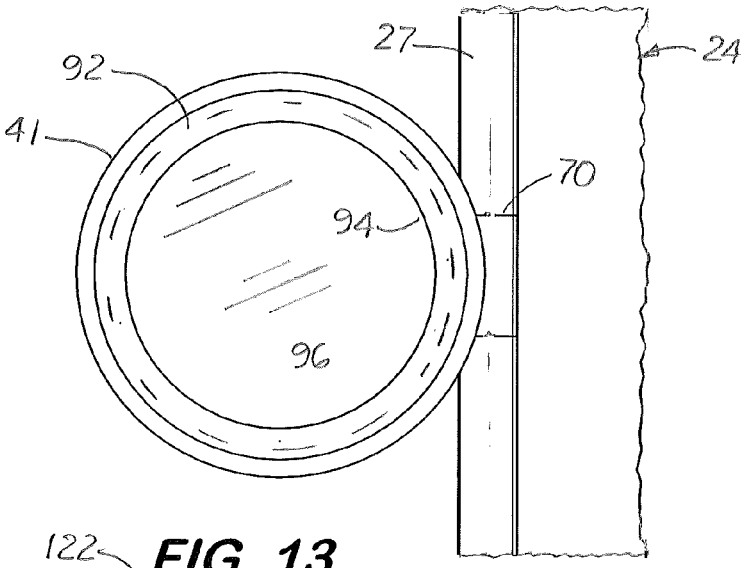
FIG. 13 is a top plan view of the holding member and cup-style container holder shown in FIG. 12.
Figure 14:
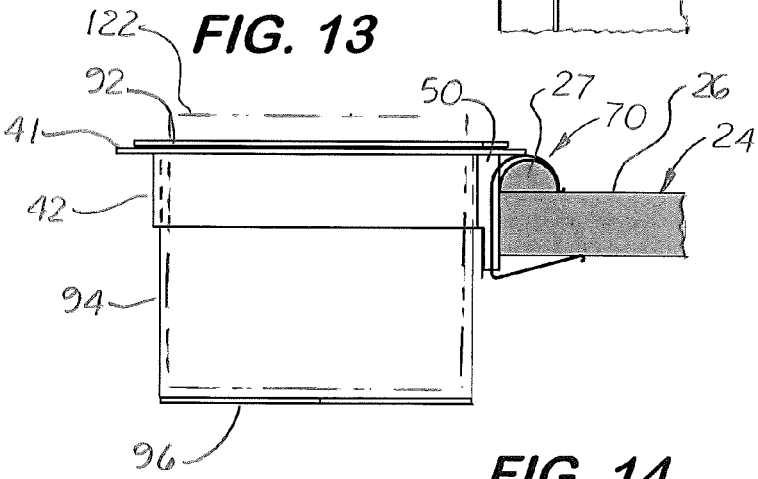
FIG. 14 is a side elevational view of the holding member and cup-style container holder shown in FIGS. 12 and 13 with a short cylindrical container placed inside the cup-style container holder.
Figure 15:
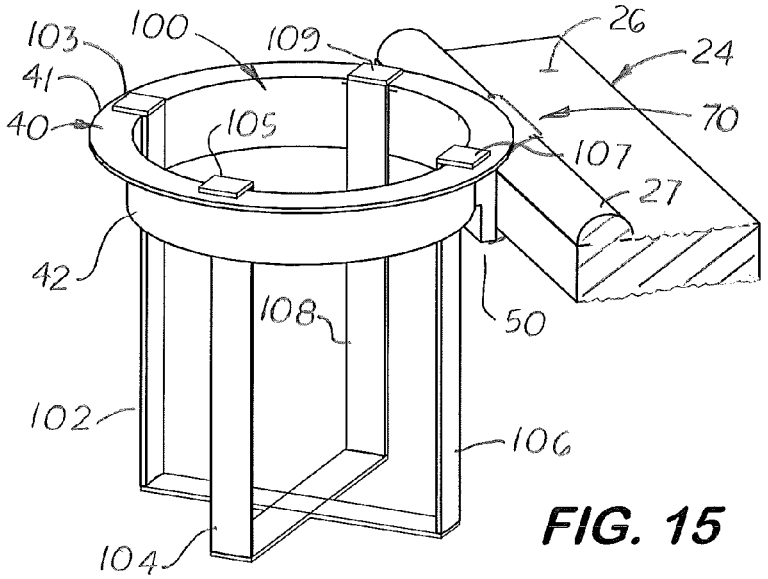
FIG. 15 is a perspective view of the holding member and cage-style container holder with a U-shaped intermediate member attached to the perimeter side edge of a table top with a ring element attached to the intermediate member and a cage-style container holder placed into the ring element's center hole.
Figure 16:
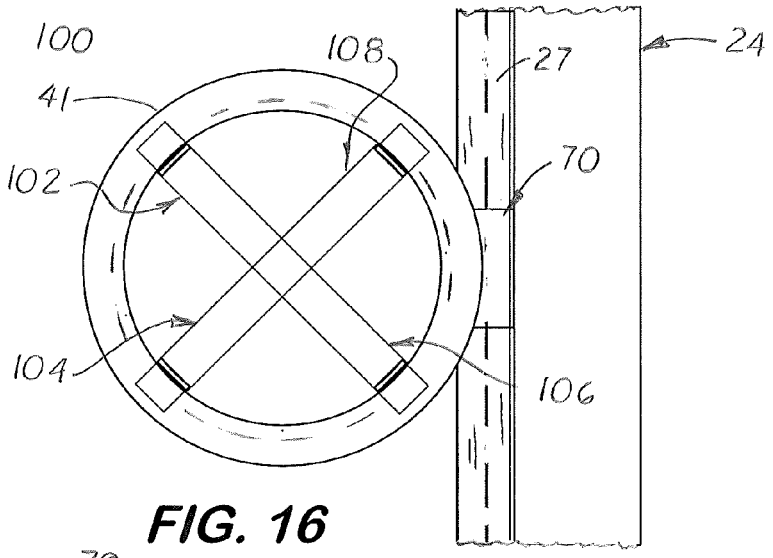
FIG. 16 is a top plan view of the holding member and cage-style container holder shown in FIG. 16.
Figure 17:
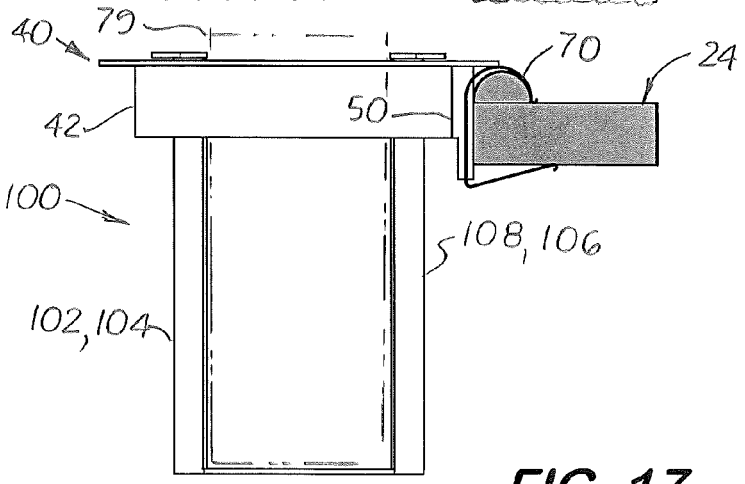
FIG. 17 is a side elevational view of the holding member and cage-style container holder shown in FIGS. 15 and 16 with a cylinder container placed therein.

In another embodiment, the disposable trash bag 80 is replaced with one or two types of container holders, a cup-style container holder 90 and a cage-style container holder 100, each configured for placement inside the center opening on the ring element 41. FIG. 12 is a perspective view of the cup-style container holder 90 with a U-shaped intermediate member 50 attached to the raised perimeter curb edge 27 of a table top 24 with the ring element 70 attached to the intermediate member 50. The cup-style container holder 90 is placed into the ring element's center hole and a writing implement 120 placed into the central storage area. The cup-style holder 90 includes a flat upper ring member 92, pendent side walls 94 and a flat bottom surface 96. In the Figs., the bottom surface 96 is a solid structure but may include holes or perforations to facilitate cleaning. The ring member 92 has a sufficient diameter so it may be supported by the ring element 41. Various objects, such as writing implement 120, a toothbrush, dental floss, gum container or a beverage container 122 may be placed in the holder 90. In another embodiment, shown in FIGS. 15-17, the disposable trash bag 80 is replaced by a cage-style container holder 100 made of two or more U-shaped clips (four clips denoted as 102, 104, 106, and 108 as shown. Each clip 102, 104, 106, 108 includes an outward extending top flange, a downward extending middle flange, and a lower transverse flange. The transverse flanges on the clips 102, 104, 106 and 108 extend over the center axis and act as a bottom support surface for a closed container 122 that may be placed into the holder 100. Examples of closed containers 122 may include beverage containers or tissue or swipe containers 79 commonly used by patients lying in a hospital bed.

The holders 90 and 100 may be made of disposable material, such as stiff cardboard, paper stock material, or made of non-disposable material, such as plastic or metallic material.

OPERATION OF THE INVENTION

An overbed table 10 is first selected and positioned at a desired location over the bed that accommodates the needs of the patient and the healthcare worker. A holding member 40 with a suitable intermediate member 60 and 70 configured to engage the perimeter side edge 25, 25' of the table top 24, 24', respectively, is then selected. A suitable location on the perimeter edge 25, 25' for the holding member 40 is then selected so trash may be easily placed into the trash bag 80 when attached thereto. The intermediate member 60 or 70 is then attached to the perimeter side edge 25, 25' on the overbed table 10. The upper and lower leaves 66, 68 and 76, 78 on the intermediate member 60 and 70, respectively, are pulled apart and pressed onto the perimeter side edge 25, 25', respectively. The slots 52 and 54 on the receiver 50 are then aligned over the vertical sleeve member 62, 72 and the receiver 50 is then forced downward to engage the intermediate member 60, 70, respectively. Alternatively, the intermediate member 60 or 70 may be attached to the sleeve member 62, 72 prior to attaching the intermediate member 60 or 70 to the perimeter side edge 25, 25'.

If a disposable trash bag 80 is desired, it is unfolded, and inserted into the center hole 46 formed in the ring element 41. The disposable bag's outer bag body 81 extends through the center opening 46 and the upper ring 82 is disposed over and positioned against the top surface of the upper flat ring element 41. Trash may then be disposed into the bag body 81. When full, the trash bag 80 expands and hangs downward from the upper ring element 41. The full trash bag 80 may be removed and discarded from the ring element 41 and replaced with a new trash bag 80. When the location of the disposable trash bag 80 is changed or when the table top 24, 24' needs to be cleaned with a suitable disinfectant, the intermediate members 60 and 70 are detached from the perimeter side edge 25, 25'.

If a container holder is desired, then either the cup-style container holder 90 is selected or a cage-style holder 100 is selected. Which container holder 90, 100 is selected depends on the object to be stored.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. An overbed table holder system, comprising:

a. an overbed table with a lower base, a vertical column, and an elongated table top with a perimeter side edge, the lower base and the vertical column and the table top being configured so the overbed table may be moved to different locations around a bed with the table top extended over a bed on which a patient is laying;

b. a ring element extending laterally from and selectively connected to the perimeter side edge of the table top, the ring element includes a center opening; and, c. a container holder disposed inside the center opening on the ring element, the container holder includes a ring element flange member and a downward extending side member surround a container opening configured to receive a container, the ring element flange member configured to extend outward and over the ring element holding the side member in a fixed position inside the center opening of the ring element.

2. The holder system as recited in claim 1, wherein the ring element is connected to an intermediate member that slides onto the table top.

3. The holder system as recited in claim 2, wherein the intermediate member includes an upper leaf and a lower leaf configured to apply a gripping force on opposite sides of the table top.

4. The holder system as recited in claim 3, wherein the ring member and the intermediate member are detachable and selectively connected together when used.

5. The holder system as recited in claim 2, wherein the ring member and the intermediate member are selectively connected together.

6. The holder system as recited in claim 1, further including a raised curb formed on the top surface of the table top and adjacent to the perimeter side edge.

7. The holder system as recited in claim 6, wherein the ring member is connected to an intermediate member and configured to press against the perimeter side edge that slides onto the perimeter side edge and that slides onto the table top and engages the raised curb.

8. The holder system as recited in claim 1, wherein the container holding includes an upper ring member configured to rest on top of the ring element and a downward extending cup with pendent side walls and a bottom surface.

9. The holder system as recited in claim 8, wherein the container holder is a cage structure made of two or more U-shaped clips connected together and configured to be supported and held by the ring member when inserted into the center opening on the ring element.

10. The holder system as recited in claim 1, wherein a beverage container, a box of tissues or a writing implement is placed inside said container holder.

* * * * *